United States Patent [19]

Kato

[11] 4,131,423

[45] Dec. 26, 1978

[54] PROCESS FOR DYEING CELLULOSE FIBERS WITH VAT OR SULFUR DYES AND OXYHALOGEN ACID

[75] Inventor: Hiroshi Kato, Chibashi, Japan

[73] Assignee: Ise Kagaku Kogyo Kabushiki Kaisha, Tokyo, Japan

[21] Appl. No.: 820,317

[22] Filed: Jul. 29, 1977

[30] Foreign Application Priority Data

Dec. 2, 1976 [JP] Japan ..... 51-144029

[51] Int. Cl.[2] ..... C09B 9/00; C09B 49/00

[52] U.S. Cl. ..... 8/34; 8/37; 8/54.2

[58] Field of Search ..... 8/34, 37

[56] References Cited

U.S. PATENT DOCUMENTS

| | | | |
|---|---|---|---|
| 3,775,047 | 11/1973 | Weston | 8/37 |
| 3,944,382 | 3/1976 | Doerr | 8/34 |
| 4,011,042 | 3/1977 | Stitzel | 8/34 |
| 4,012,192 | 3/1977 | Doerr | 8/34 |
| 4,042,319 | 8/1977 | Baum et al. | 8/34 |

*Primary Examiner*—A. Lionel Clingman

*Attorney, Agent, or Firm*—Oblon, Fisher, Spivak, McClelland & Maier

[57] ABSTRACT

A process for dyeing fibers using a water-insoluble dye such as a sulfur dye comprises reductive dissolution and oxidative fixing using an oxyhalogen acid as oxidizing agent.

10 Claims, No Drawings

PROCESS FOR DYEING CELLULOSE FIBERS WITH VAT OR SULFUR DYES AND OXYHALOGEN ACID

BACKGROUND OF THE INVENTION

Field of the Invention:

The present invention relates to a process for dyeing fibers, and more particularly relates to improvements in a process for dyeing fibers in which a water-insoluble dye such as a sulfur dye is used and fibers are dyed by the reductive dissolution and oxidative fixing of the dye using an oxyhalogen acid.

Description of the Prior Art:

Dyes such as sulfur dues, vat dyes, and the like are usually applied to fibers using a method comprises: adding an alkaline reducing agent, for example sodium sulfide or sodium hydrosulfide and NaOH, to the dye to render it soluble so that it impregnates and is absorbed into the fibers; and then oxidizing the dye with an oxidizing agent to make it water-insoluble, thus fixing the dye on the fibers. In methods of dyeing fibers with water-insoluble dyes, which include such reductive dissolution and oxidative fixing steps, the oxidation step is important in improving color tone and appearance, completing formation of color, and preventing embrittlement of the fibers.

Hitherto, bichromates have been the most widely used oxidizing agent for such oxidative fixing. However, the problem of contamination of water supplies, particularly contamination by waste water from dyeing operations using a large amount of water, have recently received considerable attention. Strict regulations are in force, particularly for chromates and other heavy metal pollutants and countermeasures against them have therefore required great expense.

Other oxidizing agents which can be used in place of bichromates in the oxidation step have been sought. Among those which have been investigated are persulfates, hydrogen peroxide, perborates, bromates, iodates and the like. However, oxidation by hydrogen peroxide has a tendency to reduce the washing durability of fibers. Moreover, lack of reproducibility and irregularity of oxidation are found. Other oxidizing agents also have undesirable effects upon fibers and are disadvantageous in cost. Thus, there is still room for further study regarding these oxidizing agents, with respect to both economic and technical aspects compared with bichromates, and further improvements therein are required.

Before fibers are fed to the oxidation step, they are usually subjected to an aqueous treatment, wherein they often show alkalinity as high as a pH value of 9 to 11. This is because sodium sulfide, sodium hydrosulfide and NaOH, or the like used for the reductive dissolution step remains therein. Furthermore, in dyeing with sulfur dyes, vat dyes or the like, it is advantageous for color formation to maintain the oxidizing bath on the acidic side as a general rule. Thus, the oxidizing bath should be maintained at an acidic pH. In the past, acetic acid, phosphoric acid and the like have been used, together with the oxidizing agent, to control the pH of the oxidizing bath. However, the amount of such acids required to maintain the desired pH is, in general, 2 to 10 times by weight that of the oxidizing agent, and this represents a very large part of the cost of the oxidation step. Moreover, use of acetic acid or the like raises the BOD of the waste water, and formation of acid salts has the further disadvantage of imposing a burden on washing after the oxidation step.

SUMMARY OF THE INVENTION

Accordingly, it is an object of the present invention to provide a process for dyeing fibers including an oxidative fixing step wherein the oxidizing agents have no polluting heavy metals in their molecules and are strongly acidic.

Another object of the invention is to provide a process using oxidizing agents such that the addition of acetic acid, phosphoric acid or the like which has hitherto been used for maintaining the acidity of the oxidizing bath can be greatly reduced, and the desired pH of the treating bath can be maintained without continual addition of other acids.

Yet another object of the invention is to provide a process for dyeing fibers which does not create a high BOD in the waste water.

Briefly, these objects and other objects of the invention as hereinafter will become more readily apparent can be attained by providing a process for dyeing fibers in which a water-insoluble dye is reductively dissolved so that it can adhere to the fibers, after which the dye is fixed on the fibers by an oxidative treatment, characterized in that an oxyhalogen acid is used as the oxidizing agent.

DETAILED DESCRIPTION OF THE PREFERRED EMBODIMENTS

In the present invention, an oxyhalogen acid is used as an oxidizing agent in the oxidative fixing step. Suitable oxyhalogen acids include iodic acid ($HIO_3$), bromic acid ($HBrO_3$) and chloric acid ($HClO_3$). Iodic acid is particularly preferred because of its ready availability, high rate of oxidation, high oxidizing power, ease of handling, and the like. In the present invention, the oxyhalogen acid is used in the form of an aqueous solution wherein it is present in a concentration of over 0.1 g/l, preferably from 0.1 to 20 g/l, more preferably 0.5 to 5 g/l. The optimum concentration is determined as a function of the extent of the water-washing of the fibers coming into the oxidation step, the amount being processed, the dye concentration, the type of treatment apparatus or system, the type of oxyhalogen acid used, and other pertinent factors.

As mentioned above, the oxidizing bath is preferably maintained at an acidic pH. In the present invention, this can be accomplished without adding another acid such as acetic or phosphoric acid because the oxyhalogen acids used as oxidizing agents are themselves strongly acidic. In a preferred embodiment, the oxidizing bath is maintained at a pH of 3 to 6 by controlling the concentration of oxyhalogen acid. Another acid may be added in cases where excess alkali is incorporated.

The oxidation treatment of the invention can be carried out at temperatures of from 20° to 100° C., preferably from 40° to 60° C.

Further variation in oxidizing conditions may be chosen in accordance with the treatment system, for example, the number and length of time of treatments.

In the oxidation step of the present invention, other well known oxidizing agents may be used together with the oxyhalogen acid, although in the preferred embodiment no other oxidizing agent is added. Suitable such other oxidizing agents include alkali metal salts of oxyhalogen acids such as $KIO_3$, $KBrO_3$ and the like. Since these salts may be produced in the oxidation step through reaction of oxyhalogen acids with alkaline reducing agents carried over from the reductive dissolution step, use of these salts together with the oxyhalogen acid in the oxidation step is, as expected, wholly within the scope of the present invention.

Addition of an acid which does not give rise to a higher BOD in the waste water poses no problem, while addition of acetic acid or the like is also acceptable if increased BOD may be tolerated.

In the present invention, dyes insoluble in water are used. Suitable such water-insoluble dyes are conventional and in general include the well known sulfur dyes, vat dyes, sulfur vat dyes and the like. Specific examples include: Kayaku Sulphur (trademark) made by Nippon Kayaku Kabushiki Kaisha, and Asathio (trademark) made by Asahi Kagaku Kogyo Kabushiki Kaisha, both sulfur dyes; Mikethren (trademark) made by Mitsui Toatsu Kagaku Kabushiki Kaisha (Mitsui Toatsu Chemical, Inc.), and Nihon Threne (trademark) made by Sumitomo Kagaku Kogyo Kabushiki Kaisha (Sumitomo Chemical Co., Ltd.), both vat dyes; and Carbanal (trademark) and Homodye (trademark) made by Nippon Kayaku Kabushiki Kaisha, and Mikeran (trademark) made by Mitsui Toatsu Kagaku Kabushiki Kaisha (Mitsui Toatsu Chemicals, Inc.), both sulfur vat dyes.

When such water-insoluble dyes are used, they are reductively dissolved in water using an alkaline reducing agent such as sulfide, sodium hydrosulfide and NaOH, and the like. The reducing dye bath may also contain conventional auxiliary agents for dyeing in combination with reducting agents. Various treatment systems and conditions can be used, according to common practice in the art. For example, addition of soda ash to assist the reducing action, or addition of Glauber's salt, sodium chloride, and the like to improve the dyeing effect is permitted. Furthermore, an alkaline reducing agent may be used in an amount slightly exceeding that required for dissolving a dye. Other conditions relating to the dissolving operation, the dissolution temperature, and the dissolution concentration are preferably chosen in accordance with the kind of dye or fiber, the dyeing concentration or related factors in conventional fashion.

In the dyeing processes of the present invention, using a water-insoluble dye, and comprising a reductive dissolution step and an oxidative fixing step, other conventional steps, for example, pretreatment of the fibers to be dyed, dyeing by a reductive dissolving liquor, water-washing after the dyeing, water-washing after the oxidation treatment, soaping, drying, and the like, may be included without departing from the scope of the invention. Furthermore, various treatment systems can be adopted, such as the vat jig method, the vat steam method, the continuous dyeing method, the intermittent dyeing method, and the like.

Typical embodiments of the fiber-dyeing process of the present invention will now be described. In the vat steam system using a sulfur dye, for example, fibers are pretreated by starch-removal, refining and bleaching to prepare an article to be dyed. The dye is suitably diluted with water and dissolved using an alkaline reducing agent. Vatting of the fibers is carried out by immersing them in the dye solution at an appropriate temperature. The fibers are then dried intermediately, reduced by a reduction liquor, and further steamed as required. After sufficient washing with water, the fibers are subjected to an oxidation treatment by an aqueous oxyhalogen acid solution. Then, the fibers are washed with water, dried, and further subjected to finishing treatments such as soaping, washing with warm water, washing with water and drying. In the vat jig system, on the other hand, fibers are washed with water after jig color development and then fed to the oxidation step, omitting the steam treatment. Of course, the above dyeing procedures can be appropriately modified in the present invention.

Thus, the present invention is characterized in that the oxidation step is carried out by use of an oxidizing agent comprising an oxyhalogen acid. According to the process of the present invention, it is possible to dye various kinds of fibers smoothly and advantageously, and excellent dyed goods can be obtained without causing the heavy metal pollution and increased BOD mentioned above. It will be seen from the examples described hereinafter that dyeing durability is also equivalent to that obtained using conventional bichromates as the oxidizing agent. In addition, concentrated solutions of oxyhalogen acids (40–50%) can easily be prepared at routine temperatures. Therefore, preparation of their treatment liquors is easy, and their handling in operation is also convenient. Since they are not composed of powdery material, operating losses are reduced.

Furthermore, production of acetates or the like is lowered to a large extent and, as a result, after-washings of the fibers such as soaping become easier. In addition, although alkaline reducing agents used for the reductive dissolution react with the oxyhalogen acid to produce alkali salts of the oxyhalogen acid when they are carried together with the dye into the oxidizing bath, these salts have an equivalent oxidizing power to the oxyhalogen acid itself.

Thus, the oxidizing agents comprising an oxyhalogen acid according to the present invention are capable of attaining a dyeing durability as high as or higher than conventional bichromates, they can be advantageously used in continuous mechanical dyeing with a high rate of color formation, and they give excellent results in the dyeing processes in which they are used.

Having generally described the invention, a more complete understanding can be obtained by reference to certain specific examples, which are included for purposes of illustration only and are not intended to be limiting unless otherwise specified.

In the examples mentioned below, the washing test according to Japanese Industrial Standard (JIS)-L-0844, the rubbing test of JIS-L-0849 and the sunlight test (ten hours; using a carbon arc lamp) of JIS-L-0842 were carried out as tests for dyeing durability.

EXAMPLES 1 TO 3 AND COMPARATIVE EXAMPLES 1 AND 2

Orange Brown 5R made by Asahi Kagaku Kogyo Kabushiki Kaisha was used as a sulfur dye and fine corduroy (100% cotton) was used as the article to be dyed. Dyeing was carried out using a bath containing 5% of the dye, 7% of sodium sulfide and 30% of Glauber's salt, with a bath ratio of 1:50 and at a temperature of 95° C. for 30 minutes. After dyeing, the articles were washed with water at 40° C. After water-washing, the solution was adjusted to and held at pH 11 and then the oxidation treatment was carried out using the oxidation treating liquors shown in Table 1, at a temperature of 55° C. for 30 minutes. Then, the oxidation treating liquors were adjusted and held at pH 4. After water-washing, the articles were further washed with water at 75° C. until the washes reached pH 7, and then dried at 100° C. The tests for the dyeing durability of the thus-dyed articles were conducted and the results are shown in Table 1. For comparison, examples in which an oxidation treating liquor containing sodium bichromate (Comparative Example 1) or potassium iodate (Comparative Example 2) was used are also shown in Table 1.

Table 1

| | | Example 1 | Example 2 | Example 3 | Comparative Example 1 | Comparative Example 2 |
|---|---|---|---|---|---|---|
| Oxidation treating liquor | Kind | aq. solution of iodic acid | aq. solution of bromic acid | aq. solution of chloric acid | aq. solution of sodium bichromate | aq. solution of $KIO_3$ |
| | Concentration | 2 g/l (calculated as solid) | 3 g/l (calculated as solid | 3 g/l (calculated as solid) | 5 g/l | 2 g/l |
| | Use of acetic acid | no addition of acetic acid | no addition of acetic acid | no addition of acetic acid | addition of acetic acid (5 g/l) | addition of acetic acid (5 g/l) |
| Dyeing durability | Washing test | 4 – 5 | 4 | 4 – 5 | 4 | 4 |
| | Rubbing test | 5 | 5 | 5 | 5 | 5 |
| | Sunlight test | 2 – 3 | 2 – 3 | 2 – 3 | 2 – 3 | 2 – 3 |

In Comparative Examples 1 and 2, the pH of the oxidation treating liquors was raised as high as 9 to 10 if acetic acid were not added, resulting in poor dyeing results.

EXAMPLES 4 TO 6 AND COMPARATIVE EXAMPLES 3 AND 4

Nihon Threne Olive T made by Sumitomo Kagaku Kogyo Kabushiki Kaisha (Sumitomo Chemical Co., Ltd.) was used as a vat dye and fine corduroy (100% cotton) was used as the articles to be dyed. Dyeing was carried out using a bath containing 2% of the dye, 3 g/l of sodium hydrosulfide, 20 cc/l of 40° Be sodium hydroxide, 20% of Glauber's salt, with a bath ratio of 1:50, and at a temperature of 75° C. for 30 minutes. After dyeing, the articles were washed with water at 40° C. After water-washing, the solution was adjusted and held at pH 11 and then the oxidation treatment was carried out using the oxidation treating liquors shown in Table 2 at a temperature of 55° C. for 30 minutes. Then, the oxidation treating liquors were adjusted and held at pH 4. After water-washing, the articles were further washed with water at 75° C. until the pH of the washes reached 7, and then dried at 100° C. The tests for the dyeing durability of the thus-dyed articles were conducted and the results are shown in Table 2. For comparison, examples in which an oxidation treating liquor containing sodium bichromate (Comparative Example 3) or potassium iodate (Comparative Example 4) was used are also shown in Table 2.

Table 2

| | | Example 4 | Example 5 | Example 6 | Comparative Example 3 | Comparative Example 4 |
|---|---|---|---|---|---|---|
| Oxidation treating liquor | Kind | aq. solution of iodic acid | aq. solution of bromic acid | aq. solution of chloric acid | aq. solution of sodium bichromate | aq. solution of $KIO_3$ |
| | Concentration | 1 g/l (calculated as solid) | 1.5 g/l (calculated as solid) | 1.5 g/l (calculated as solid) | 2.5 g/l | 1 g/l |
| | Use of acetic acid | no addition of acetic acid | no addition of acetic acid | no addition of acetic acid | addition of acetic acid (5 g/l) | addition of acetic acid (5 g/l) |
| Dyeing durability | Washing test | 4 | 4 | 4 | 4 | 4 |
| | Rubbing test | 4 – 5 | 4 – 5 | 4 – 5 | 4 – 5 | 4 – 5 |
| | Sunlight test | 3 | 3 | 3 | 3 | 3 |

In Comparative Examples 3 and 4, the pH of the oxidation treating liquors was raised as high as 9 to 10 if acetic acid were not added, resulting in poor dyeing results.

EXAMPLES 7 TO 9 AND COMPARATIVE EXAMPLES 5 AND 6

Kayaku Homodye Blue-RL-S made by Nippon Kayaku Kabushiki Kaisha was used as a sulfur vat dye and fine corduroy (100% cotton) was used as the articles to be dyed. Vatting of the articles was carried out using a vatting bath containing 50 g/l of the dye at 85° C. After vatting, the articles were intermediately dried at a temperature of 100° C. The reduction treatment was carried out using an aqueous solution containing 45 g/l of sodium hydrosulfide, 70 cc/l of 40° Be sodium hydroxide and 30 g/l of Glauber's salt as a reduction treating liquor at 60° C. After the articles were steamed for 30 seconds, they were washed with water at a temperature of 40° C. After water-washing, the solution was adjusted and held at pH 10. Then, the oxidation treatment was carried out using the oxidation treating liquors shown in Table 3, at a temperature of 55° C. The oxidation treating liquors were kept at pH 4. After water-washing, the articles were further washed with water at a temperature of 75° C. until the pH of the washes reached 7, and then dried at 100° C. The tests for the dyeing durability of the thus-dyed articles were conducted and the results, along with the results for Comparative Examples 5 and 6 are shown in Table 3.

Table 3

| | | Example 7 | Example 8 | Example 9 | Comparative Example 5 | Comparative Example 6 |
|---|---|---|---|---|---|---|
| Oxidation treating liquor | Kind | aq. solution of iodic acid | aq. solution of bromic acid | aq. solution of chloric acid | aq. solution of sodium bichromate | aq. solution of $KIO_3$ |
| | Concentration | 2 g/l (calculated as solid) | 3 g/l (calculated as solid) | 3 g/l (calculated as solid) | 5 g/l | 2 g/l |
| | Use of acetic acid | no addition of acetic acid | no addition of acetic acid | no addition of acetic acid | addition of acetic acid (5 g/l) | addition of acetic acid (5 g/l) |
| Dyeing durability | Washing test | 4 - 5 | 4 | 4 | 4 | 4 |
| | Rubbing test | 5 | 5 | 5 | 5 | 5 |
| | Sunlight test | 2 - 3 | 2 - 3 | 2 - 3 | 2 - 3 | 2 - 3 |

In the Comparative Examples 5 and 6, the pH of the oxidation treating liquors was raised as high as 9 to 10 if acetic acid were not added, resulting in poor dyeing results.

Having now fully described the invention, it will be apparent to one of ordinary skill in the art that many changes and modifications can be made thereto without departing from the spirit or scope of the invention as set forth herein.

What is claimed as new and desired to be secured by Letters Patent of the United States is:

1. In a process for dyeing cellulosic fibers, in which a water-soluble dye selected from the group consisting of sulfur dyes, vat dyes and sulfur vat dyes is reductively dissolved for adherence to the fibers and the dye is then fixed on said fibers by an oxidative treatment, the improvement which comprises using an oxyhalogen acid selected from the group consisting of $HClO_3$, $HBrO_3$ and $HIO_3$ as an oxidizing agent for said oxidative treatment.

2. The process of claim 1, in which said water-insoluble dye is a sulfur dye.

3. The process of claim 1, in which said oxyhalogen acid is iodic acid.

4. The process of claim 1, in which said oxyhalogen acid is bromic acid.

5. The process of claim 1, in which said oxyhalogen acid is chloric acid.

6. The process of claim 1, in which said oxidative treatment is carried out at a temperature of from 20° to 100° C.

7. The process of claim 1, in which said oxidative treatment is carried out while maintaining the pH at 3 to 6, without adding any acid other than oxyhalogen acids.

8. The process of claim 1, in which said oxidative treatment is carried out using an aqueous solution containing an oxyhalogen acid in a concentration of at least 0.1 g/l.

9. The process of claim 1, in which said water-insoluble dye is a vat dye.

10. The process of claim 1, in which said water-insoluble dye is a sulfur vat dye.

* * * * *